US007126881B2

(12) United States Patent
Cooper et al.

(10) Patent No.: US 7,126,881 B2
(45) Date of Patent: Oct. 24, 2006

(54) CUSTOMIZABLE TIMEPIECE DEVICE

(75) Inventors: Martin R. Cooper, Cincinnati, OH (US); Kimberly R. Taylor, Cincinnati, OH (US)

(73) Assignee: 8 Point 5 Concepts, Ltd., Cincinnati, OH (US)

( * ) Notice: Subject to any disclaimer, the term of this patent is extended or adjusted under 35 U.S.C. 154(b) by 101 days.

(21) Appl. No.: 10/144,376

(22) Filed: May 13, 2002

(65) Prior Publication Data

US 2003/0210614 A1 Nov. 13, 2003

(51) Int. Cl.
*G04B 19/00* (2006.01)
*G04B 25/00* (2006.01)

(52) U.S. Cl. ..... 368/223; 368/285

(58) Field of Classification Search ..... 368/10, 368/223, 80, 228, 232, 227, 285, 294–297
See application file for complete search history.

(56) References Cited

U.S. PATENT DOCUMENTS

| | | | | |
|---|---|---|---|---|
| 258,801 | A | 5/1882 | Payson, Jr. | |
| 2,224,421 | A | 12/1940 | Aaron | |
| 2,547,487 | A | 4/1951 | Penney | |
| 2,853,804 | A * | 9/1958 | Bengeyfield | 434/304 |
| 3,316,709 | A | 5/1967 | Edwards | |
| 3,608,214 | A | 9/1971 | Rancati | |
| 3,763,645 | A | 10/1973 | Kim | |
| 4,312,055 | A * | 1/1982 | Noble | 368/29 |
| 4,332,020 | A | 5/1982 | Leopold | |
| 4,660,992 | A | 4/1987 | Paul et al. | |
| 4,684,264 | A | 8/1987 | Paperno et al. | |
| 4,993,006 | A * | 2/1991 | Oshima et al. | 368/231 |
| 5,018,118 | A | 5/1991 | Ross | |
| 5,124,959 | A * | 6/1992 | Yamazaki et al. | 368/231 |
| 5,168,479 | A | 12/1992 | Lima | |
| 5,184,848 | A | 2/1993 | Itoh et al. | |
| 5,224,078 | A * | 6/1993 | Mallin | 368/223 |
| 5,375,102 | A | 12/1994 | Schiavolini | |
| 5,646,913 | A | 7/1997 | Quesenberry | |
| D421,921 | S * | 3/2000 | Giardiello | D10/39 |
| 6,208,591 | B1 * | 3/2001 | Sakurazawa et al. | 368/67 |
| 6,278,662 | B1 * | 8/2001 | Gruber | 368/28 |
| 6,416,216 | B1 * | 7/2002 | Haughey | 368/89 |
| 6,491,424 | B1 * | 12/2002 | Tardy | 368/283 |
| 6,621,765 | B1 * | 9/2003 | Guhl | 368/80 |

FOREIGN PATENT DOCUMENTS

| | | |
|---|---|---|
| GB | 161397 | 4/1921 |

* cited by examiner

*Primary Examiner*—Kamand Cuneo
*Assistant Examiner*—Thanh S. Phan
(74) *Attorney, Agent, or Firm*—Dinsmore & Shohl LLP

(57) ABSTRACT

The present invention relates to a timepiece device, and more particularly to a timepiece device having a customized dial. The timepiece device has a housing and a face plate attached to the housing. The face plate has a peripheral rim which has a plurality of intermittently spaced lands. Each land is configured to provide a surface for receiving customized indicia. An outer cover which can be removed or opened to provide access to customize the face plate is provided.

2 Claims, 7 Drawing Sheets

CUSTOMIZABLE TIMEPIECE DEVICE

The present invention relates to a timepiece device and more particularly to a timepiece device having a customizable face plate.

BACKGROUND OF THE INVENTION

Timepieces such as watches have been used for the primary purpose of keeping and displaying time for many years. Timepiece watch faces come in a variety of styles, types and versions allowing for wide ranging uses and style preference. While many different timepiece designs have been created, including various watch faces and band styles, the appearance and visual functionality of most timepieces is not customizable after the timepiece has been created. In fact, while the band of some timepieces may be replaceable, typically, the appearance of the face plate of most watches or timepieces does not change and is not changeable by the wearer. Accordingly, it would be advantageous to provide a timepiece device in which the appearance of the face plate of the watch could be easily and conveniently changed as desired by the wearer.

Moreover, while some timepieces have been designed to allow for some customization of certain aspects of the timepiece by the user, these designs typically require a number of intricate pieces which makes manufacturing more costly and expensive. Similarly, the intricate pieces of these designs provide complicated mechanisms for allowing customization. Such complicated designs may preclude children or others from having the ability to actually customize the timepiece and make the customization process inconvenient, thereby limiting the market for which the timepiece could be sold. Accordingly, it would be advantageous to provide a timepiece device in which the face plate of the watch could be simply and easily changed as desired by a user of virtually any age.

Finally, it would be advantageous to provide a timepiece wherein customizing the face plate of the timepiece did not affect the time displayed by the watch or affect the users ability to view the displayed time. For example, the time displayed by some timepieces which allow for customization, is affected during the customization process. In these designs, the watch or timepiece must be reset or re-synchronized to display the correct time. As a result, customization or individualization of the timepiece may be more difficult and time consuming than expected, thereby defeating the purpose of the watch.

SUMMARY OF THE INVENTION

One embodiment of the present invention provides a timepiece device that includes a housing and a face plate attached to said housing. The base plate has a peripheral rim which includes a plurality of intermittently spaced lands. Each land is configured to provide a surface for selectively and interchangeably receiving customized indicia.

Another embodiment of the invention provides a timepiece device with a housing that has a movement viewing area. The timepiece device also with a face plate that covers at least a portion of the movement viewing area and has a peripheral rim located adjacent said movement viewing area for receiving customized indicia. An outer cover covers at least a portion of the peripheral rim and the cover is moveable between an open and closed position.

Yet another embodiment of the invention is presented as a method of customizing a timepiece device having a housing, a face plate having a peripheral, and an outer cover covering at least a portion of the peripheral rim and movable between an open and closed position. The method comprises the steps of opening the outer cover and exposing the peripheral rim, selectively placing and/or removing one or more customized indicia on the peripheral rim, and closing the outer cover.

Other objects, advantages and novel features of the present invention will become apparent to those skilled in the art from the following detailed description, which illustrates various exemplary modes contemplated for carrying out the invention. As will be realized, the invention is capable of other different aspects all without departing from the invention. Accordingly, the drawings and descriptions are illustrative in nature and not restrictive.

BRIEF DESCRIPTION OF THE DRAWINGS

While the specification concludes with claims particularly pointing out and distinctly claiming the present invention, it is believed that the same will be better understood from the following description, taken in conjunction with the accompanying drawings, in which:

DETAILED DESCRIPTION OF EXEMPLARY EMBODIMENTS

Reference will now be made in detail to various embodiments of the invention, various examples of which are illustrated in the accompanying drawings, wherein like numerals indicate corresponding elements throughout the views.

Figure 1:
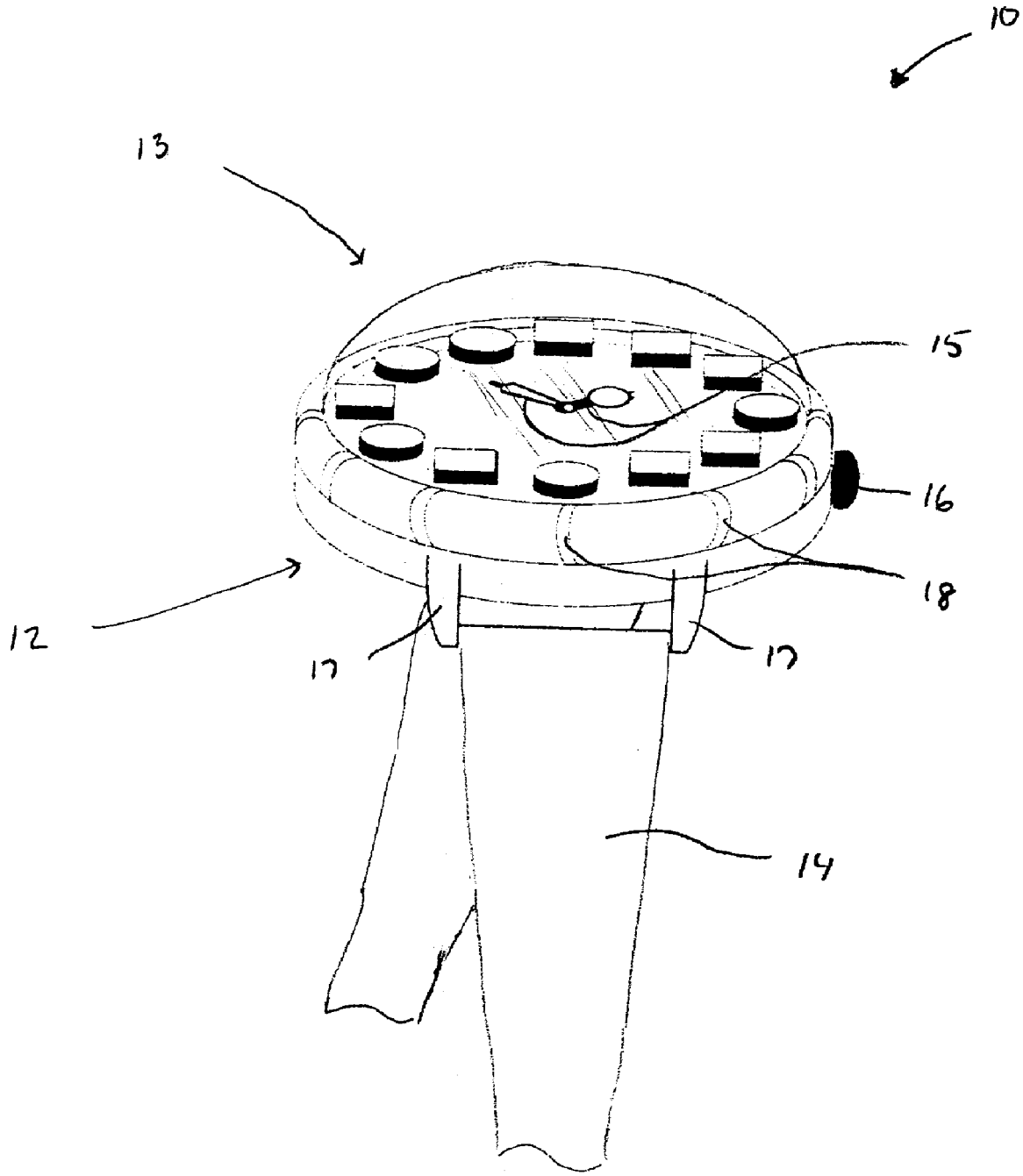
FIG. 1 depicts a partial perspective view of a timepiece device in accordance with an exemplary embodiment of the present invention.

FIG. 1 depicts an exemplary embodiment of a timepiece device 10 as contemplated by the present invention. The timepiece device 10 comprises a housing 12, and a cover 13 that is openable and/or removable from the housing 12. As will be described in more detail, the cover 13 of the present invention can be designed to be openable and/or removable to allow the user of the timepiece 10 to be able to customize or individualize the face plate of the timepiece as desired. As one of skill in the art will appreciate, the timepiece device 10 of the present invention may also comprise any number of other optional components such as, but not limited to, a watch band 14 (band closure not shown) integrally or separately attached to the timepiece via holders 17 and a spring loaded pin 45 (as illustrated in FIG. 2*a*), one or more mechanical or electronic indicator arms or hands 15, a functional or decorative crown 16, or other functional or decorative features such as grooves 18 (which not only enhance the decor of the timepiece, but also provide a "gripping" surface for allowing a user to easily and conveniently open and/or remove the outer cover 13).

Figure 2A:
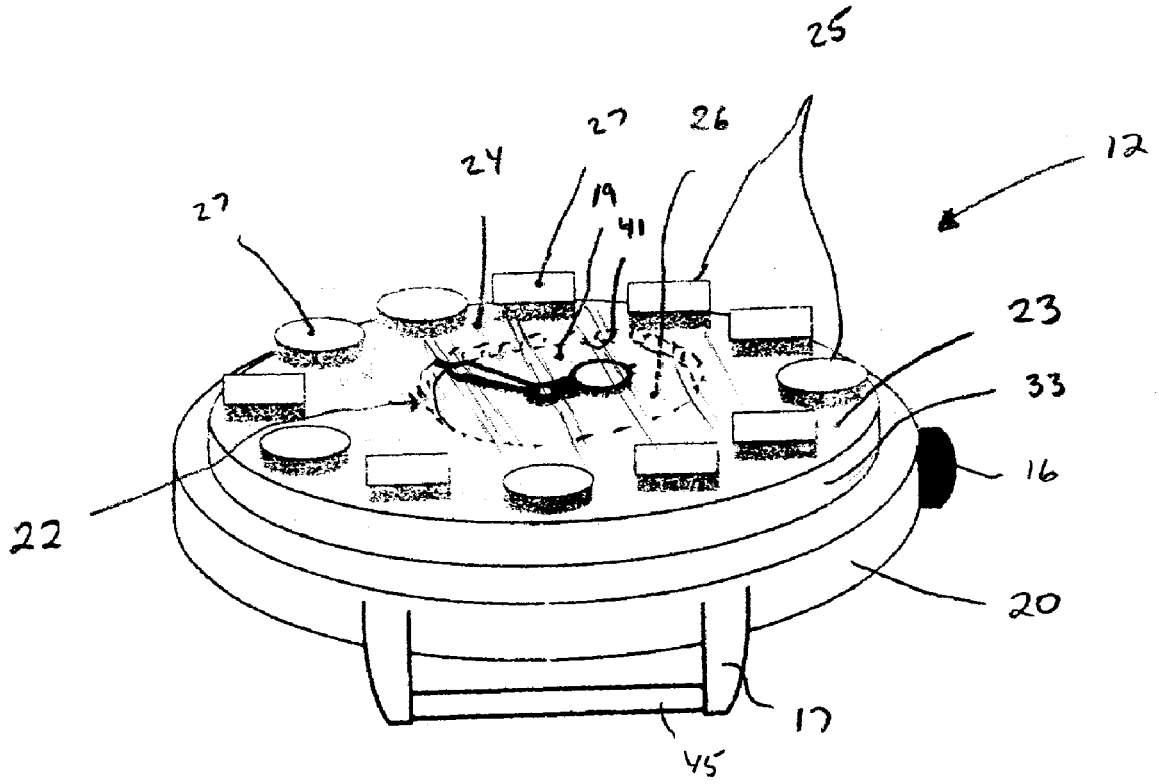
FIG. 2*a* depicts a perspective view of an exemplary housing of the timepiece device as depicted in FIG. 1 as contemplated by the present invention.

FIG. 2*a* illustrates an exemplary perspective view of the housing 12 as illustrated in FIG. 1 in accordance with one embodiment of the present invention. In this embodiment, the housing 12 comprises a base 20 and a face plate 23. The base 20 and face plate 23 may be formed as a single integral unit, or, may be formed separately and attached together to form a single integral unit. As shown in FIG. 2*a*, the face plate 23 is contemplated as attaching to and cover at least a portion of the base 20.

In an exemplary embodiment of the invention, the face plate 23 may comprise a crystal portion 19 and a peripheral rim 24 positioned adjacent the crystal portion 19. As one of skill in the art should recognize, the crystal portion 19 and peripheral rim 24 may be formed as a single integral unit, or, may be formed separately and attached to the base 20 as single or separate components. For example, in an exemplary embodiment of the invention, the base 20 may comprise an outer rim 33 and an inner rim 41, which both extend radially from the base. In this embodiment, the peripheral rim 24 may be attachable between the outer rim 33 and the inner rim 41 of the base 20 in any variety of well known ways such as soldering, gluing or otherwise adhering, or mechanically attaching such as through screwing, crimping, snapping and the like. Additionally, in this embodiment of the invention, the crystal portion 19 may be attachable to the inner rim 41 of the base 20 by pressure and/or gluing or by any of the other well known ways in the art. In another example, the face plate may comprise an integral crystal portion 19 and peripheral rim 24, which may be attached to the outer rim 33 of the base in any practical manner.

In an exemplary embodiment of the invention, the base 20 may be manufactured from stainless steel or other suitable material and the peripheral rim 24 may be manufactured from aluminum or other suitable material. Additionally, the crystal portion 19 may be manufactured from a transparent material such a plastic, lexan, or glass crystal to allow the user to view the time as displayed by the timepiece.

While the exemplary embodiment has been described with the base 20 and face plate 23 comprising certain materials, it should be recognized that these components or any component of the timepiece device 10 could be manufactured from any suitable plastic, composite, rubber or metal material. Additionally, it should be recognized that the face plate 23 including the peripheral rim 24 could be manufactured as an integral unit from a single material such as a transparent rubber, glass or plastic and subsequently attached to the base 20. Moreover, it is also contemplated that, depending on the materials selected, the timepiece 10 may be designed and manufactured to be water resistant or even water proof.

As further illustrated in FIG. 2*a*, the base 20 is illustrated with a generally circular shape. As one of skill in the art might recognize, the base 20 is not limited to such a shape, but could rather be of any desirable shape such as square, triangular, oval, heart, polygonal, teardrop or other shape. As will be described in more detail, one of the only limitations on the shape of the base 20 is its ability to house some or all of the mechanical and electrical components of the timepiece. Additionally, while the face plate 23 is also contemplated to be a circular shape, it is also not limited to such a shape and could be any shape suitable to provide a surface area for customization and viewing of the time as displayed by the timepiece.

Figure 2B:
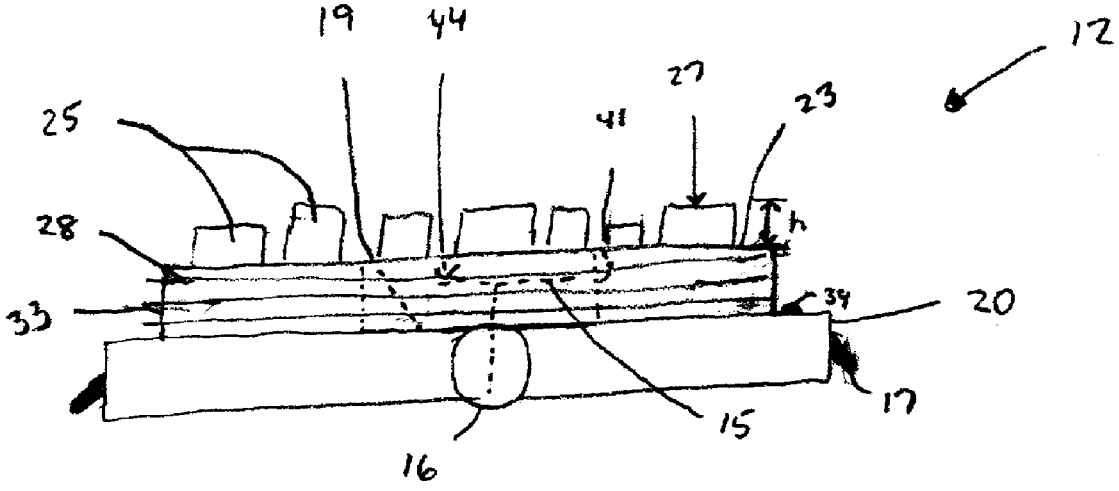
FIG. 2*b* depicts a side elevational view of the exemplary housing of the timepiece device as depicted in FIG. 1 in accordance with the present invention.

As illustrated in FIG. 2*b*, an elevational view of an exemplary embodiment of the timepiece device as illustrated in FIG. 1, the base 20 and face plate 23 separately or in combination house (or at least partially enclose) the mechanical and electrical components of the timepiece 10 including the mechanical or electrical indicator arms or hands 15. In more detail, in this embodiment, the housing 12 comprises a cavity 44 which receives the mechanical and electrical components of the timepiece 10, and the face plate 23 attaches thereto to form a housing which protects the timepiece components. It should be recognized that the base 20 may further comprise an inner dial face 26 that separates the mechanical indicator arms 15 from the rest of the mechanical and electrical components. The inner dial face 26 may comprise a decorative surface coating that contrasts with the mechanical indicator arms of the timepiece to provide easy recognition of the displayed time.

In one embodiment of the invention, the housing 12 may comprise the mechanical and electrical components similar to those of a traditional watch or timepiece, and display the time through one or more movable mechanical indicator arms or hands 15 in place of one or more mechanical arms. In another embodiment of the invention, the housing 12 may comprise components that provide one or more "virtual" indicator arms 15. The virtual indicator arms may simulate mechanical indicator arms 15 or may provide an indication of time in some other way. For example, a liquid crystal display or some other form of electrical or virtual display may be utilized to simulate indicator arms 15, light up portions of the watch face, and/or display some other indication of time. Still another embodiment of the invention contemplates the use of a liquid crystal display to display the time in a digital format.

Figure 2C:
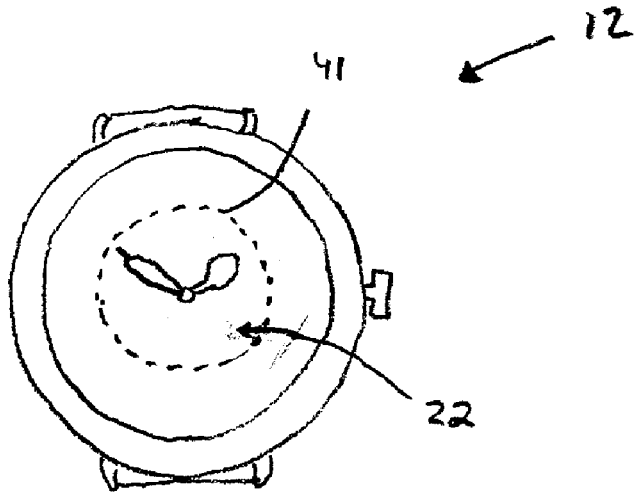
FIG. 2*c* depicts a top-plan view of another exemplary housing of a timepiece device as depicted in FIG. 1 as contemplated by the present invention.

FIG. 2*c* depicts a top plan view of the housing 12 as contemplated in the exemplary embodiment depicted in FIG. 1 of the present invention. As illustrated in this embodiment, the housing 12 comprises a movement viewing area 22 for viewing the time displayed by the timepiece 10. As used herein, the term "movement viewing area" 22 is contemplated to mean the portion of the timepiece that displays the time. In other words, the movement viewing area 22 is contemplated to be the area or portions that a user would view to find the time as indicated by the timepiece.

While it should be recognized that the movement viewing area 22 may be as large as the surface area of the base 20, in an exemplary embodiment of a timepiece of the invention, the movement viewing area 22 is the portion of the timepiece that displays the time as indicated by the dotted line in FIGS. 2*a* and 2*c*. While in this exemplary embodiment, the movement viewing area is depicted as the circular area defined by the inner rim 41 of the base 20 which surrounds the indicator arms or hands 15 of the timepiece, the area 22 is not limited to being circular, but could be any shape or combination of shapes that is sufficient to allow the user to view the time as displayed by the device. For example, the movement viewing 22 may be a rectangular shape if a rectangular liquid crystal display is used by the timepiece to display the time. Additionally, the movement viewing area, need not be a single continuous portion, rather it could be, for example, spaced rings or spaced dots or the like. Finally, it should be recognized that the movement viewing area 22 may be enclosed and protected by the crystal portion 19 of the face plate 23.

Referring back to FIG. 2*a*, it should be recognized that the face plate 23 is contemplated to be customizable with indicia as desired by the user or wearer. In particular, the peripheral rim 24 of the face plate 23 may comprise one or more intermittently spaced raised lands or protuberances 25 at desired locations. As will be explained in more detail, the lands or protuberances 25 provide a surface area 27 for receiving customized indicia 35 has illustrated in the Figures, which may be of virtually any shape or arrangement. For example, as illustrated in the exemplary embodiment of FIG. 2*a*, the lands or protuberances 25 may have a square or circular shape and may be equally spaced around the peripheral rim 24 at traditional "hour" locations on a timepiece. In light of this example, it should be recognized that the lands 25 could be of virtually any shape or arrangement such as, but not limited to, a square, a circle, a triangle, an oval, a heart, a teardrop, or any other shape that provides a surface area 27 for receiving customized indicia 35.

As best illustrated in FIG. 2*b*, the surface area 27 of the lands 25 may be at a height "h" above the outer surface of face plate 23. While in the exemplary embodiment the height "h" of each land may be approximately the same, it should also be recognized that the lands 25 do not have to be the same height, some could be lower/higher than the others. Additionally, one or more of the lands may have no height, rather, the shape of the land may be imprinted or etched on the peripheral rim to indicate a desired surface 27 for placing customized indicia or one or more lands may be recessed, which would indicate designated landing spots for the customized indicia. It is also contemplated that the entire peripheral rim 24, with or without lands, may be raised a uniform or non-uniform height. In this embodiment, customized indicia 35 could be placed along any portion of the rim 24. Finally, it should recognized from the foregoing that although the lands could of virtually any shape, arrangement or configuration, providing slightly raised lands may facilitate the placement and/or removal of customized indicia and may be more convenient for the user.

Figure 3:
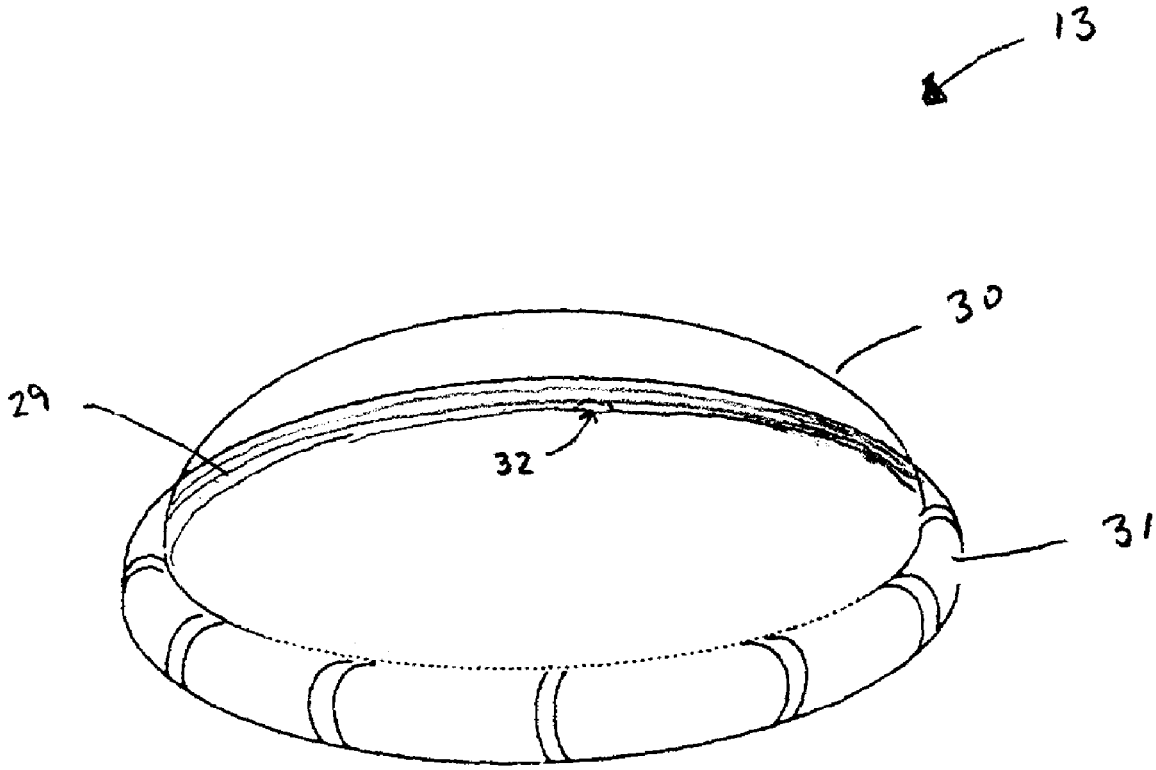
FIG. 3 depicts a perspective view of an exemplary outer cover of a timepiece device as contemplated by the present invention.

FIG. 3 depicts an exemplary outer cover 13 of a timepiece 10 as contemplated by FIG. 1 of the present invention. The cover 13 is configured to be openable and/or removable with respect to the timepiece 10 and is illustrated here as comprising a crystal 30 and an bezel 31. While the cover 13 is contemplated to have a crystal 30 such as a glass or plastic, the cover 13 may also be of any number of other embodiments such as a skeleton "cage" or even a solid metal or plastic cover that requires removal to view the time.

In an exemplary embodiment of the invention, the cover 13 is crystal 30 and is configured to be screwed and unscrewed from the timepiece device 10 as desired by the user. In more detail, the bezel 31 of the cover 13 may be configured to engage the outer rim 33 of the base 20 as depicted in FIG. 2*b*. The outer rim 33 of the base 20 may comprise threads 28 which are configured to receive mating threads 29 located on the inner circumference of the bezel 31. In this way, the outer cover 13 is openable/removable from the housing 12 by screwing/unscrewing the cover as desired by the user.

The base 20 may further comprise a spring loaded ball bearing 34 configured to mate with a cavity 32 located on the circumference of the bezel 31. The spring loaded ball bearing 34 and mating cavity 32 are designed to ensure sufficient engagement and prevent over-tightening of the bezel portion with respect to the timepiece device 10. For example, the user of the timepiece device 10 may feel or hear a "click" when the ball bearing "clicks" or moves into the cavity. Additionally, once the ball bearing 34 engages the cavity 32, the cover 13 should be prevented from being inadvertently or accidentally unscrewed from the timepiece device 10.

As one of skill in the art will recognize, providing the cover 13 and base 20 with mating threads is not the only way to provide an openable and/or removable outer cover in other embodiments, the cover 13 may snap, hinge, slide/lock or otherwise be openably and/or removably attached to the timepiece 10. Regardless of the embodiment chosen to provide an openable and/or removable cover 13, it should be recognized that the bezel will be movable between two positions: an open position and a closed position. In the open position, the face plate 23 is exposed to the user thereby allowing the user to customize the face plate 23 as desired. In contrast, in the closed position, the housing 13 encloses and protects the face plate 23 and any customized indicia 35 adhered to the face plate.

Figure 4:
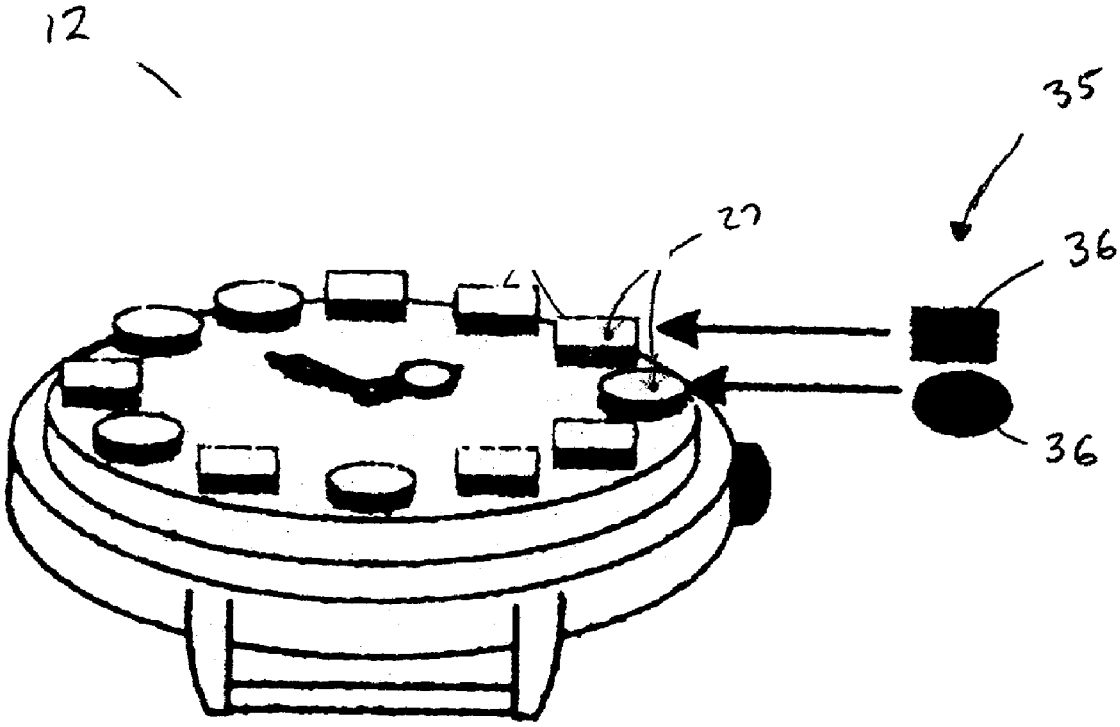
FIG. 4 depicts a perspective view of the housing of a timepiece device illustrating the customizable face of the timepiece in accordance with an exemplary embodiment of the present invention.

As illustrated in FIG. 4 and as should be recognized from the foregoing, the face plate 23 is configured to be selectively customized or individualized by the user of the timepiece with customized indicia 35. For example, in one embodiment of the invention, a plurality stickers 36 having any sort of expression can be sold with or separately from the timepiece 10 and are contemplated to be the same general size and shape as the surface area 27 of at least some of the plurality of lands 25 such that the stickers 36 are removable and replaceable with respect to each land 25 as desired by the user. The stickers 36 could display any variety or combination of expression, such as letters, numbers, characters, symbols, or any other indicia. In this embodiment, it is contemplated that the stickers 36 may comprise a pressure sensitive adhesive to allow the stickers to be removable and replaceable. Additionally, the stickers 36 may comprise a material which is capable of adhering or sticking to the surface area 27 of the lands 25 without the use of an adhesive such as a high-static vinyl.

Figure 5:
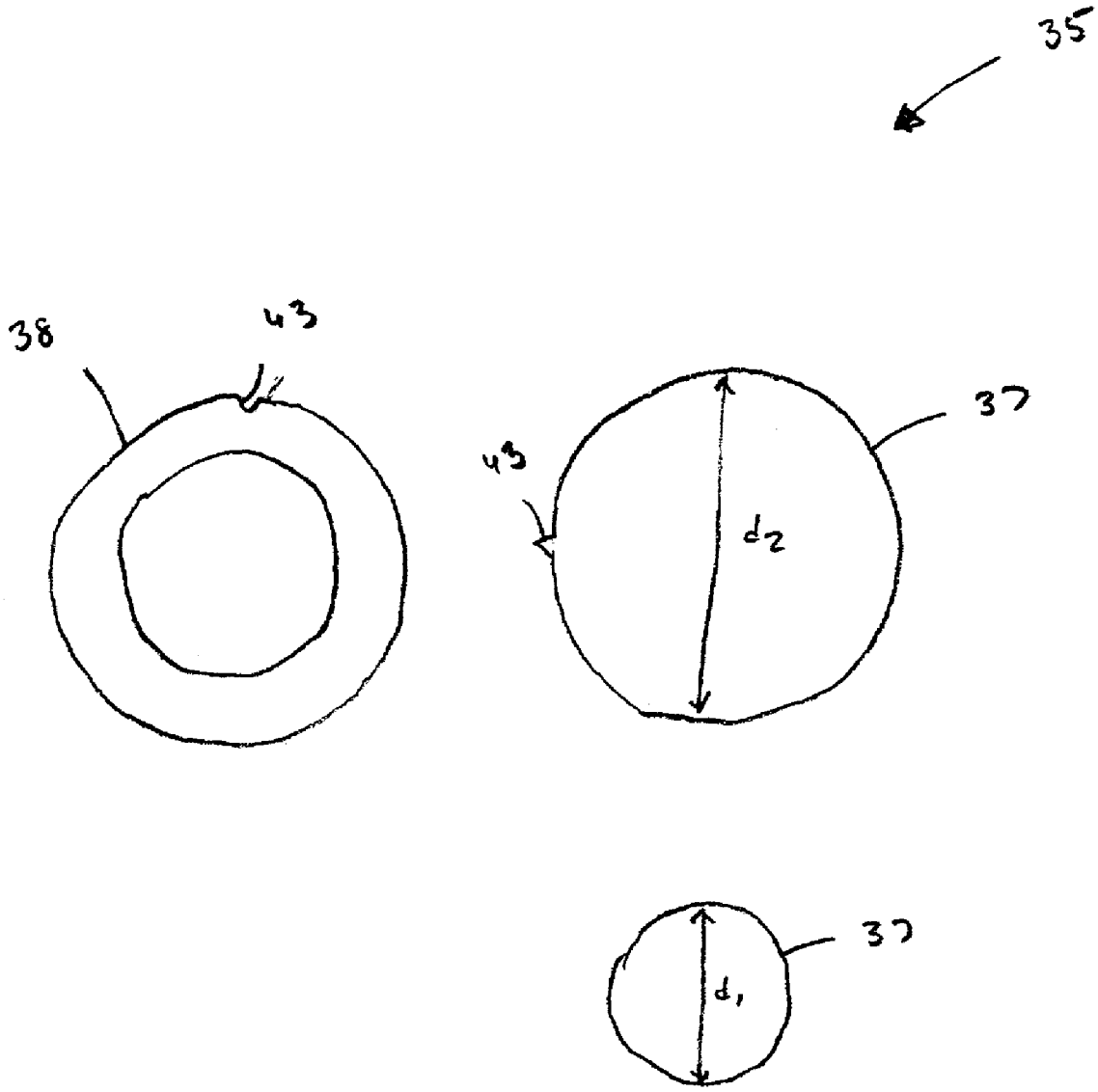
FIG. 5 depicts a top-plan view of numerous customizable indicia as may be used with an exemplary timepiece device as illustrated in FIGS. 1–4 in accordance with the present invention.

In another embodiment of the invention, as illustrated in FIG. 5, the customized indicia 35 may comprise decorative plates designed to be removable and replaceable with respect to the face plate 23. Like the stickers 36, the decorative plates can be sold with or separately from the timepiece and are contemplated to be ring shaped 38, disc shaped 37 or generally any shape that is capable of fitting on the face plate 23 and between the face plate 23 and outer cover 13 when it is in a closed position. The decorative plates may be configured with a protuberance and/or slot 43 arrangement which holds the plate in a certain position with respect to the timepiece to prevent rotation or movement thereof.

The ring shaped 38 decorative plates may be configured to lay or rest on the surface area 27 of the plurality of lands 25 or may be configured to lay flush on the peripheral rim 24 of the face plate 23, or on top of lands 25. In these embodiments, it is contemplated that the ring shaped 38 decorative plates may lay adjacent the movement viewing area 22 without interfering with visualization of the area. Alternatively, the ring shaped 38 decorative plates could be transparent in nature so as to allow for visualization of the movement viewing area 22.

Disc shaped 37 decorative plates could also be sold with or separately from the timepiece. It is contemplated that the disc shaped 37 decorative plates may be of sufficiently small diameter ($d_1$) to lay on the flush on the face plate 23 and adjacent to the lands 25, or may be of sufficiently large diameter ($d_2$) to lay on the surface area 27 of the plurality of lands 25. It is contemplated that any portion of the face plate that the covers the movement viewing area 22 would preferably be transparent or at least translucent to allow for sufficient viewing of the movement viewing area.

The decorative plates (e.g. ring shaped 38, disc shaped 37, or other shape) could be provided with a pressure sensitive adhesive that allows the decorative plates to be removable and replaceable with respect to the lands 25 or the peripheral rim 24 or any other portion of the face plate 23. Alternatively, the decorative plates may comprise a material, such as a high static vinyl, that sticks or adheres to any part of the face plate 23 without the use of an adhesive. In another embodiment, the decorative plates could rest or lay on the lands 25 or on the face plate 23 and be held firmly in place by the removable/openable crystal. For example, the outer crystal 30 of the cover 13 could be configured such that upon attaching the cover 13 to the housing 12, the crystal 30 wedges and holds the decorative plate against the lands 25 or face plate 23. Finally, it should also be recognized that the customized indicia 35 (i.e. ring shaped 38 and disc shaped 37 decorative discs and stickers 36) might be used separately or in combination to customize and individualize some or all of surface area of the customizable face plate 23.

It should be recognized from the foregoing that the customized indicia 35 may be provide with or sold separately from the timepiece device 10. In one embodiment of the invention, a kit may be sold separately which allows the user or wearer to make decorative indicia 35 such as from personal photographs, logos, or any other decor of interest.

Figure 6:
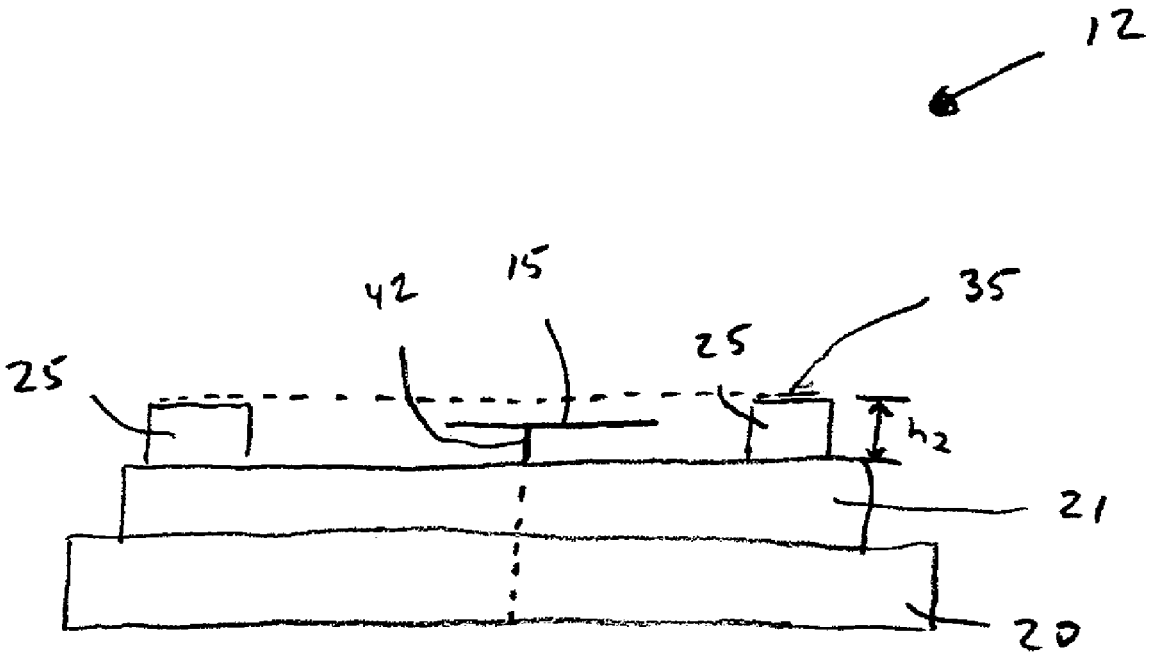
FIG. 6 depicts side elevational view of an alternate embodiment of a timepiece device in accordance with an exemplary embodiment of the present invention.

FIG. 6 illustrates an alternate embodiment of a timepiece device 10 in accordance with the present invention. In this embodiment, it is contemplated that the some of the mechanical and electrical components of the timepiece 10 (not shown), particularly the mechanical indicator arms or hands 15, are not housed within the housing 12. In this embodiment, it is contemplated that the shaft 42 that drives the mechanical indicator arms 15 extends through the face plate 23 such that the mechanical indicator arms or hands 15 are positioned adjacent the outer surface of the face plate 23.

While the lands or protuberances 25 may once again be of any height, in this embodiment, it is contemplated that at least some of the lands or protuberances 25 may be configured to be a height"$h_2$" such that the surface area 27 of the lands 25 is located at a predetermined distance above the height of the indicator arms 15. In this way, customized indicia 35 such as ring shaped 38 and disc shaped 37 decorative plates or stickers 36 could still be removable and replaceable with respect to the lands 25 without interfering with movement of the indicator arms 15. Additionally, in this embodiment, the cover 13 would enclose and protect both the customizable indicia 35 as well as the indicator arms 15.

Having shown and described the various embodiments of the present invention, further adaptations of the timepiece device of the present invention as described herein can be accomplished by appropriate modifications by one of ordinary skill in the art without departing from the scope of the present invention. Several of these potential modifications and alternatives have been mentioned, and others will be apparent to those skilled in the art. For example, while exemplary embodiments of the timepiece device have been discussed for illustrative purposes, it should be understood that the elements described will be constantly updated and improved by technological advances. Accordingly, the scope of the present invention should be considered in terms of the following claims and is understood not to be limited to the details of structure, operation or process steps as shown and described in the specification and drawings.

We claim:

1. A timepiece system comprising:

a time piece device including:

a housing including a movement viewing area for viewing the current time kept by an indicator arm of the timepiece device;

a face plate attached to said housing and having an elevated peripheral rim comprising a plurality of intermittently spaced raised lands, wherein each of said lands is configured to provide an area for receiving customized indicia, wherein each of said lands is positioned at an hour position about the peripheral rim of the face plate, wherein the height of at least one of the lands is greater than the height of the indicator arm, wherein the indicator arm has a circular movement path, wherein all of the lands are located outside of the indicator arm movement path, wherein the lands are positioned on the elevated peripheral rim, and wherein the height of the peripheral rim is greater than the height of the indicator arm;

a band attached to the housing;

a plurality of removable and replaceable customized indicia, wherein each of said indicia adheres to one of said raised lands;

a second plurality of removable and replaceable indicia separate from the timepiece device, wherein each indicia is sized and configured to adhere to one of said raised lands; and an outer cover covering the peripheral rim and movable between an open and closed position, wherein the outer cover is removably attached at a point below the peripheral rim.

2. A method of customizing a timepiece device having a housing, a face plate having a peripheral rim including a plurality of intermittently spaced land areas, and an outer cover covering at least a portion of the peripheral rim, the cover being movable between an open and closed position, the method comprising the steps of:

opening said outer cover and exposing said peripheral rim of said face plate and said intermittently spaced land areas;

placing one or more of said customized indicia on one or more of said land areas such that each customized indicia is secured to a land area, wherein each customized indicia is sized to correspond with at least one land area and wherein each indicia comprises a sticker comprising an adhering material for securing to said land area;

closing said outer cover;

re-opening said outer cover;

unsecuring a customized indicia from a land area and replacing the customized indicia with a second customized indicia; and adhering said unsecured customized indicia to another land area using said adhering material.

* * * * *